United States Patent [19]

Anderberg et al.

[11] Patent Number: 4,623,847

[45] Date of Patent: Nov. 18, 1986

[54] METHOD AND APPARATUS FOR STORING AN ENERGY-RICH ELECTRON BEAM IN A RACE-TRACK MICROTRON

[75] Inventors: Bengt Anderberg, Upsala; Mikael Eriksson, Lund, both of Sweden

[73] Assignee: Instrument AB Scanditronix, Upsala, Sweden

[21] Appl. No.: 621,225

[22] Filed: Jun. 15, 1984

[30] Foreign Application Priority Data

Jun. 17, 1983 [SE] Sweden ..... 8303501

[51] Int. Cl.[4] ..... H05H 13/00; H05H 13/04

[52] U.S. Cl. ..... 328/234; 313/62; 328/235

[58] Field of Search ..... 328/234, 230, 235; 313/62

[56] References Cited

U.S. PATENT DOCUMENTS 3,343,020 9/1967 Gordon ..... 328/234 X 4,123,720 10/1978 Rosander et al. ..... 328/234

FOREIGN PATENT DOCUMENTS 1016622 1/1966 United Kingdom ..... 328/234

OTHER PUBLICATIONS

"NBS-Surf II: A Small, Versatile Synchrotron Light Source," by G. Rakowsky, *IEEE Transactions on Nuclear Science,* vol. NS-28, No. 2, Apr. 1981, pp. 1519-1521.

*Primary Examiner*—Palmer C. DeMeo

*Attorney, Agent, or Firm*—Lewis H. Eslinger

[57] ABSTRACT

Method and apparatus in a race-track microtron for storing an energy-rich electron beam. Electrons are accelerated by repeatedly passing them through a linear accelerator that is arranged between two bending magnets, which change the electrons path so that they repeatedly pass through the linear accelerator. The electrons thereby move in orbits (3 . . . 8) with a race-track-like configuration and have successively larger orbits. A deflecting magnet (9') and a septum magnet (9'') are arranged in conjunction with the greatest orbit (8). The characteristic features of the invention is that the microtron has a storage ring (10) closed in itself, for accelerated electrons. The storage ring is situated outside the septum magnet (9'') and in the pole gap of each bending magnet (6, 7). A kicker magnet (16) is arranged in the storage ring (10).

5 Claims, 6 Drawing Figures

METHOD AND APPARATUS FOR STORING AN ENERGY-RICH ELECTRON BEAM IN A RACE-TRACK MICROTRON

BACKGROUND OF THE INVENTION

Energy-rich electron beams for the production of synchrotron light are used for research purposes within physics and industry. Such electron beams are produced in an accelerator, usually a synchrotron, from which the beam is taken to a separate storage ring, usually having a circumference of more than 30 meters and which is situated in a place separate from the accelerator. The electron beam is stored in the storage ring with the aid of electromagnets and magnetic lenses. An apparatus of the kind described in the introduction is the BESSY plant in Berlin, which permits storage of an electron beam with the energy of 800 MeV and with a beam current of over 250 mA. The BESSY synchrotron and its separate storage ring permits the generation of so-called synchrotron light, i.e. light which contains wavelengths in a continuous spectrum through the visible range and down to 17.6 Å. Other similar plants exist.

The disadvantage of the known apparatus is the large and voluminous storage ring, which makes the costs for a plant of the kind described in the introduction forbiddingly high.

SUMMARY OF THE INVENTION

The present invention relates to an apparatus of the kind described above, which avoids the disadvantages of the known apparatus by placing the storage ring for the accelerated electrons in the injector itself, no separate storage ring thus being required. This is achieved in that a race-track microtron is used as an injector. The surperficial requirement of such a microtron is about $7\times2.5$ meter, from which it will be seen that the injector and the storage ring form an extremely compact unit.

In the race-track microtron according to the present invention, accelerated high-energy electrons are supplied or pumped to the electrons in the storage ring, which permits the possibility of attaining high electron current with low current in the accelerator. The beam current is of the order of magnitude of 100 mA in one embodiment of the invention.

BRIEF DESCRIPTION OF THE DRAWINGS

The invention will now be described in detail in conjunction with the accompanying drawings in which.

DESCRIPTION OF THE PREFERRED EMBODIMENT

Figure 1:
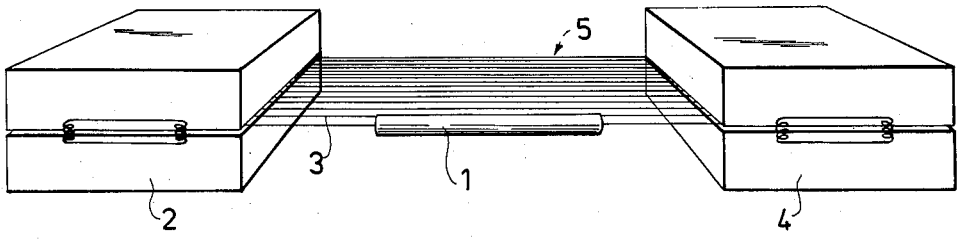
FIG. 1 is a perspective view of a known microtron.
Figure 3:
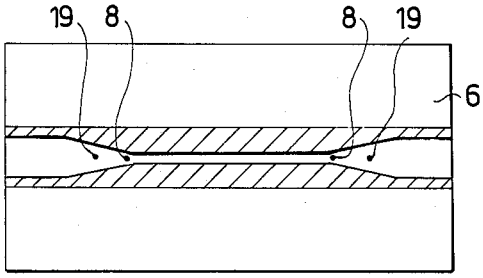
FIG. 3 is a front view of a bending magnet implemented according to the present invention, FIG. 4 schematically illustrates a septum magnet in end view as seen along the line IV—IV in FIG. 2, illustrating how the beam is injected into the storage ring.

FIG. 1 illustrates the general appearance of a known race-track microtron. Electrons from an electron source, not shown, are accelerated in a linear accelerator 1, called linac, and enter into the space between the two opposing pole plates of a dipole magnet 2, called bending magnet, where the accelerated particle describes a semicircular path and goes out from the bending magnet 2 along a first straight path 3 into a corresponding gap between the pole surfaces of a second dipole magnet 4, also called a bending magnet, where the accelerated particle once again describes a semicircular path, after which it leaves the bending magnet 4 in a path going through the linear accelerator 1, in which the particle is accelerated once again, deflected in the bending magnet 2, leaves this along a new straight path situated outside the path 3, is deflected in the bending magnet 4, leaves this in a path going through the linear accelerator 1 and coinciding with the previous path through the accelerator, with the particle being accelerated still further. The described sequence is repeated while the accelerated particles moves in successively greater orbits which have successively increasing diameters and which are shown by the general reference numeral 5 in FIG. 1. It will thus be understood that the particle is accelerated each time it passes through the linear accelerator 1. The orbits have the configuration of a race-track, and thereof the name of the microtron, the appearance of which is more clear from FIG. 2. The time it takes for an accelerated particle to travel a turn is in the order of magnitude 50 ns and the linear accelerator is activated or driven at a frequency of 3 GHz.

Figure 4:
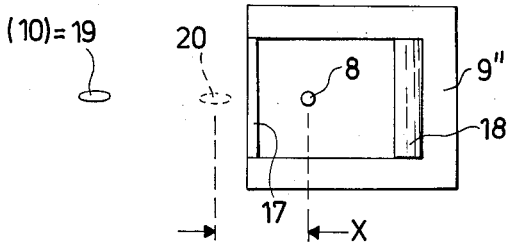
Figure 2:
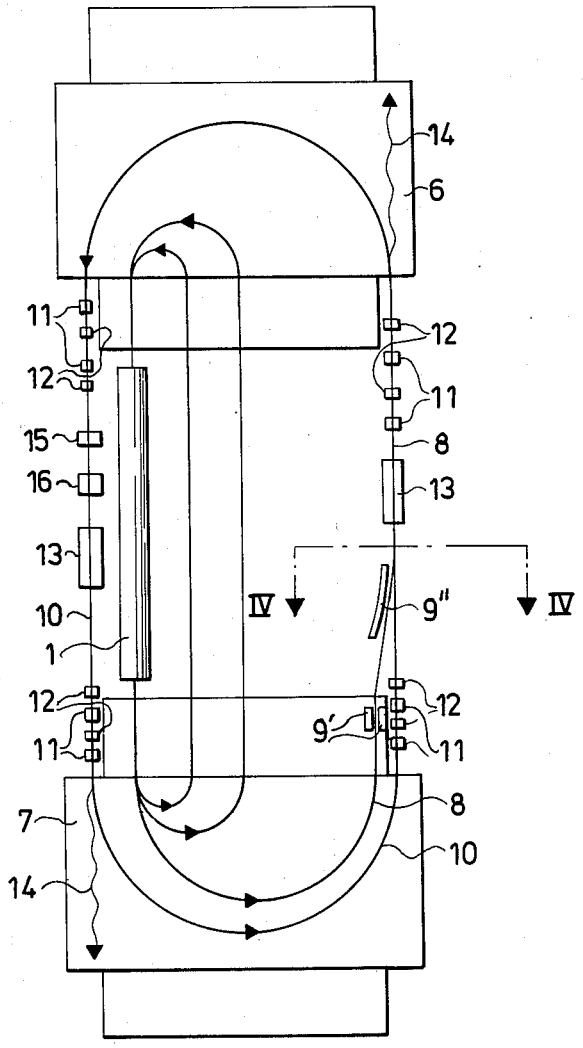
FIG. 2 is a general view of a race-track microtron with a storage ring according to the present invention.

FIG. 2 illustrates a general view of a race-track microtron in accordance with the present invention. The microtron conventionally includes the linear accelerator 1 arranged between the two dipole magnets 6, 7, called bending magnets. The outmost orbit of the race-track, i.e. the orbit containing electrons with the highest energy, is denoted by 8, and in close association with this orbit there is a deflection magnet 9' and a septum magnet 9'', schematically illustrated in FIG. 2 and more clearly apparent from FIG. 4. There is a storage orbit 10 outside the septum magnet 9'', the former also being called a storage ring, for the accelerated high-energy electrons. The storage ring 10 is thus inside the microtron, the latter thus constituting an injector for injecting accelerated electrons into the storage ring. Along the storage ring there is a plurality of magnetic lenses, so-called quadrupoles 11 disposed for focusing the electron beam. There are also a plurality of sextupoles 12 along the storage ring, and these may be said to have the task of carrying out certain error corrections in the storage ring. The units 11 and 12 are wellknown to one skilled in the art and their mutually relative disposition does not need to be described further. In the illustrated embodiment of the invention two so-called WIGGLER magnets 13 are also arranged in the storage ring 10. The WIGGLER magnets 13 are disposed symmetrically with relation to the bending magnets 6, 7, e.g. in the manner illustrated in FIG. 2. The task of the WIGGLER magnets is to generate synchrotron light, schematically denoted by the arrows 14. The WIGGLER magnets are known and are described in "IEEE transactions of Nuclear Science", Vol. NS-28, No. 3, June 1981. Synchrotron light is also generated, although to a lesser extent, inside the bending magnets and independent of the WIGGLER magnets. With the object of compensating for energy losses as a result of synchrotron light generation a cavity 15, known per se, is arranged in the storage ring 10. Finally, a so-called kicker magnet 16 of the conventional type, e.g. the same type as in the above-mentioned BESSY synchrotron in Berlin, is arranged in the storage ring 10. The function of the kicker magnet 15, when activated, is to disturb the electron flow in the storage ring 10 in a manner which will be described in detail below in conjunction with FIG. 4. This Figure shows the septum magnet 9'' and its septum 17, with the latter serving as a separating wall and extending between the legs of the septum magnet 9''. The septum magnet is an electromagnet fed with current passing through a coil 18. The septum 17 itself may be a copper plate with a thickness tapering from such as 2 mm at the input end to such as 0.5 mm at the output end, seen in the direction of electron travel along the storage ring 10.

The electrons in the storage ring move in an equilibrium orbit 19 which is self-enclosed, i.e. an electron in this orbit returns to the same plane turn after turn. The electrons which are not in the equilibrium orbit oscillate about it. The electrons in the outmost orbit 8 are deflected towards the septum magnet 9'' with the aid of the deflection magnet 9', and with the aid of the magnetic field of the septum magnet 9'' the deflected electrons are injected into an orbit close to the equilibrium orbit 19. To avoid the injected electrons colliding with the septum 17 after one or a few turns in the storage orbit 10 the equilibrium orbit 19 is disturbed with the aid of the kicker magnet 16 so that at the instant of injection, i.e. the instant when particles are injected into the storage ring, the orbit 20 denoted by dashed lines is closer to the septum 17. When the electrons are then injected, which is done by activating the septum magnet, they will oscillate about the disturbed equilibrium orbit 20 with an amplitude corresponding to the distance x between the injected beam and the position 20 of the disturbed equilibrium orbit at the injection instant. By successively decreasing the magnetic field of the kicker magnet after injection, the distance of the disturbed equilibrium orbit from the septum 17 is increased, and the injected electrons will not collide with the septum after some turns or laps, but will oscillate undisturbed about the equilibrium orbit which is shifting outwards from the septum 17. In this way there is obtained after the injection a plurality of particles which oscillate around the undisturbed equilibrium orbit with oscillation amplitudes defined by the distance x between the injected beam and the equilibrium orbit at the injection instant.

Figure 5:
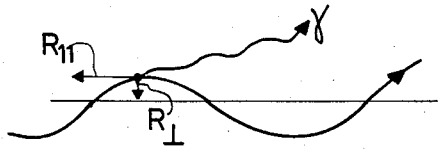
FIG. 5 illustrates schematically, seen in a plane of right angles to the bending plane of the bending magnet, the osciallating movement of an electron emitting a photon.

As mentioned above, the accelerated particles emit synchrotron light partly on passing the WIGGLER magnets 13, and partly during bending in the bending magnets 6 and 7. Such light is emitted when the electron energy is in the order of magnitude of about 400 MeV. When an electron oscillates about its equilibrium orbit and sends out a photon $\gamma$ the electron is subjected to a recoil. If we consider the oscillation movement of the electron in a plane at right angles to the bending plane of the bending magnets, i.e. if we consider the oscillating movement of the electrons in a transverse direction, the recoil force can be divided into two components in the manner apparent from FIG. 5. The component R11 is compensated in the cavity 15 in which the energy loss of the particle is compensated. The components R⊥ is always counterdirected to the particle movement and thus attenuates the oscillation energy of the electron in the transverse direction. The attenuation time is typically in the order of magnitude ms. The attenuation makes itself known by a contraction of the beam in the transverse direction, i.e. in the axial direction at right angles to the bending plane of the bending magnets.

Figure 6:
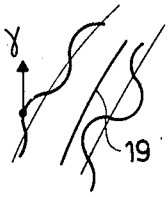
FIG. 6 illustrates the equilibrium ring seen in the bending plane of the bending magnet, for an electron emitting a photon.

If the action of the recoil on a particle in the bending plane of the bending magnets is considered, i.e. in the longitudinal direction, the picture is somewhat more complicated. In the horizontal plane the equilibrium orbit of the particles is a function of the electron energy. the particles with greater energy have an equilibrium orbit which mostly lies outside the nominal equilibrium orbit 19 (counted in relation to the septum, for example). If an electron releases a photon when it is outside this nominal equlibrium orbit, it is given a new equilibrium orbit which is situated inside the preceding one, and in this case the particle increases its oscillation amplitude. This is illustrated in FIG. 6. On the other hand, if the electron is inside the nominal equilibrium orbit, or when a photon is emitted, the electron oscillation path is similarly displaced inwardly, but in this case the oscillation amplitude of the electron decreases. The intensity of the electron beam, i.e. the number of particles per time unit, is proportional to $E^2B^2$, where E is the electron energy and B the strength of the magnetic field. In accordance with the present invention, it is now arranged that the magnetic field strength in the bending magnets 6, 7 decreases with increasing radius, resulting in that the oscillation amplitude of the electrons is attenuated in a longitudinal direction. Such a magnetic field, decreasing with increasing radius, is arranged in accordance with the invention by the pole surface of the bending magnets diverging from each other in the manner illustrated in FIG. 2 in the area outside the outmost orbit 8. The oscillation amplitude of electrons which have emitted photons will thus be attenuated in all directions by this measure, and the electron beam will contract i.e. it will "cool" in popular parlance. By waiting a suitable time, in the order of magnitude 10 milliseconds, after injection electrons into the storage ring, additional electrons may, in accordance with the invention, be injected further to the ones already entrained. By repeating this process there is successively achieved higher circulating currents in the storage ring, and the obtained circulating currents are considerably higher than those which can be obtained with a single injection.

In a preferred embodiment of the invention, the microtron and its storage ring have a surface requirement of $6.7 \times 2.4$ m2, and the maximum electron energy is 420 MeV. The critical wavelength of the synchrotron light is 17,6 Å in this case, and an electron needs 21 turns or laps before it reaches the outmost orbit 8. The stored electron beam power is 275 W and the beam current is 100 mA. The magnetic field between the pole pieces of the dipole magnets 6 and 7 is 1.75 (Tesla) and diminishes outwardly, counted from the last orbit 8, to become about 1.4 T in the region of the storage ring 10. The distance between the last orbit 8 and the storage ring 19 is 20 cm.

The embodiment of the invention described above can be modified in many different ways and can be varied within the scope of the inventive concept.

We claim:

1. A race-track microtron for storing an energy-rich electron beam, and including a linear accelerator (1) arranged between two pairs of bending magnets (6, 7)

such that said linear accelerator accelerates electrons and injects same into a magnetic field of one of said pairs of bending magnets, whereby said electrons travel in successive racetrack-like orbits of increasing width, in which each successive orbit has a common portion passing through said linear accelerator thereby repeatedly accelerating the electrons; a deflection magnet (9') and a septum magnet (9''), which are arranged in connection with the orbit (8) having the greatest diameter and a kicker magnet (16), characterized by a storage ring (10), closed on itself, for accelerated electrons arranged outside the septum magnet (9'') and in the pole gap of each bending magnet (6, 7), said kicker magnet (16) being disposed in said storage ring (10) and in that two opposing pole surfaces in each bending magnet (6, 7) diverge outwardly, relative to the orbit (8) having the greatest diameter.

2. Race-track microtron as claimed in claim 1, wherein the electrons in the storage ring (10) have an energy of at least about 400 MeV, characterized in that the magnetic field in the area of the orbit (8) with the greatest diameter is in the order of magnitude of 1.75 T and that it diminishes successively to become about 1.4 T in the area of the storage ring (10), and in that the distance between said orbit and ring (9, 10) is about 2 dm.

3. Race-track microtron as claimed in claim 2, characterized in that a WIGGLER magnet (13) is placed in the storage ring for generating synchrotron light, and in that a cavity (15) is placed in the storage ring (10) for compensating the energy loss of the stored beam as a result of emitted synchrotron light.

4. Race-track microtron as claimed in claim 3, characterized in that the WIGGLER magnet has a strength of 6 T, whereby the critical wavelength for synchrotron light will be about 17 Å and in that the magnetic field of the bending magnets is 1.75 T, whereby the bending radius for the orbits in the race-track will be about 0.8 m.

5. Method of storing an energy-rich electron beam in a race-track microtron, which includes a linear accelerator (1) arranged between two pairs of bending magnets (6, 7) in which said linear accelerator accelerates electrons and injects same into a magnetic field of one of said pairs of bending magnets, whereby said electrons travel in successive racetrack-like orbits of increasing width, in which each successive orbit has a common portion passing through said linear accelerator thereby repeatedly accelerating the electrons; a deflection magnet (9') and a septum magnet (9'') arranged in connection with the orbit (8) having the greatest diameter; and a kicker magnet for disturbing the state of equilibrium of an electron orbit, the method characterized by the steps of arranging the kicker magnet in a storage ring (10) situated outside the orbit (8) with the largest diameter and activating the kicker magnet for temporarily displacing an equilibrium orbit of the electrons in the storage ring (10) into the vicinity of a septum (17) of the septum magnet (9), injecting the electrons in the orbit (8) with the largest diameter into the temporarily displaced storage ring (20) by activating the septum magnet and subsequently successively deactivating the kicker magnet (16) whereby the equilibrium orbit for the storage ring moves outwards and contracts, inter alia as a result of the magnetic field between the pole surface of the two pairs of bending magnet diminishing in an outward direction relative to the orbit (8) with the greatest diameter.

* * * * *